US005195829A

United States Patent [19]

Watkins et al.

[11] Patent Number: 5,195,829

[45] Date of Patent: Mar. 23, 1993

[54] FLAT BOTTOMED STAND-UP MICROWAVE CORN POPPING BAG

[75] Inventors: Jeffrey T. Watkins, Eden Prairie; Lawrence C. Brandberg, Edina, both of Minn.

[73] Assignee: Golden Valley Microwave Foods Inc., Edina, Minn.

[21] Appl. No.: 735,374

[22] Filed: Jul. 24, 1991

Related U.S. Application Data

[63] Continuation-in-part of Ser. No. 604,759, Oct. 26, 1990, Pat. No. 5,044,777.

[51] Int. Cl.[5] ..... B65D 30/16; B65D 30/20

[52] U.S. Cl. ..... 383/100; 383/104; 383/120; 383/124

[58] Field of Search ..... 383/38, 40, 104, 120, 383/121, 122, 124, 125, 100; 426/107, 113

[56] References Cited

U.S. PATENT DOCUMENTS

| | | | |
|---|---|---|---|
| 2,041,227 | 5/1936 | Chalmers | 229/87 |
| 2,149,872 | 3/1939 | Schmidt | 229/58 |
| 3,027,261 | 3/1962 | Samara | 99/171 |
| 3,052,554 | 9/1962 | Colman | 99/171 |
| 3,286,832 | 11/1966 | Pilger | 206/56 |
| 3,293,048 | 12/1966 | Kitterman | 99/171 |
| 3,637,132 | 1/1972 | Gray | 229/53 |
| 3,851,574 | 12/1974 | Katz | 426/107 |
| 3,873,735 | 3/1975 | Chalin et al. | 426/87 |
| 3,970,241 | 7/1976 | Hanson | 229/58 |
| 4,038,425 | 7/1977 | Brandberg et al. | 426/107 |
| 4,219,573 | 8/1980 | Borek | 426/107 |
| 4,450,180 | 5/1984 | Watkins | 426/107 |
| 4,553,010 | 11/1985 | Bohrer et al. | 219/10.55 E |
| 4,571,337 | 7/1986 | Cage et al. | 383/100 |
| 4,691,374 | 9/1987 | Watkins et al. | 383/104 |
| 4,735,513 | 4/1988 | Watkins et al. | 383/116 |
| 4,851,246 | 7/1989 | Maxwell et al. | 219/10.55 E |
| 4,864,090 | 9/1989 | Maxwell et al. | 426/107 |
| 4,878,765 | 11/1989 | Watkins et al. | 383/116 |
| 4,892,744 | 1/1990 | Ylvisaker | 383/120 |
| 4,904,488 | 2/1990 | LaBaw et al. | 426/107 |
| 4,982,064 | 1/1991 | Hartman et al. | 426/107 |

FOREIGN PATENT DOCUMENTS

| | | |
|---|---|---|
| 81544 | 12/1956 | Denmark . |
| 1786047 | 11/1971 | Fed. Rep. of Germany . |

*Primary Examiner*—Gary E. Elkins
*Attorney, Agent, or Firm*—James V. Harmon

[57] ABSTRACT

A package is described comprising a bag with a pair of opposing face panels joined by longitudinally extending centrally projecting gussets. The bottom of the bag has a strong permanent seal containing a stiffening member or stay. The top has a rupturable seal formed from thermoplastic adhesive that allows the top to open during popping to form a vent. The bottom seal includes adhesive seals that extend diagonally from the center of the bag obliquely toward the side edges and is pinched shut to provide a temporary fin seal across the entire lower end of the bag. The temporary fin seal is folded down and bonded to an outside face of the bag to provide the stiffening stay member. During cooking, the popping of corn expands the bag and forms a bottom wall which is held quite flat by the cooperation of the bottom diagonal seals and the stiffening stay member.

7 Claims, 5 Drawing Sheets

FLAT BOTTOMED STAND-UP MICROWAVE CORN POPPING BAG

This is a continuation-in-part of our prior application Ser. No. 604,759, filed Oct. 26, 1990, now U.S. Pat. No. 5,044,777.

FIELD OF THE INVENTION

The present invention relates to food packaging and more particularly to a flexible bag suited for popping popcorn in a microwave oven.

BACKGROUND OF THE INVENTION

Various kinds of square cut or square end gusseted bags have been previously proposed for popping corn in a microwave oven. U.S. Pat. No. 4,691,374 describes a cooking bag in which diagonal gusset seals are provided at the bottom of the bag (FIGS. 1, 3 and 4). Although very good, the bag does have certain shortcomings. Many consumers want a bag that will stand up straight (like a flat-ended paste-bottom bag) when placed on a horizontal surface so that they can easily reach into the bag to take a handful of popcorn. FIG. 9 of the patent has a generally oval shape resembling an inflated football with a fin seal 42 that projects outwardly from the bottom of the bag. While formed from a strip of continuous roll stock which is substantially less expensive than a pasted bottom bag, the bag has at least three shortcomings. First, the bag will not stand upright when placed on a horizontal surface. In addition, the bag will not hold its shape reliably. This causes it to fall over easily if an attempt is made to stand it on end. Third, in the work leading to the present invention, we have now discovered that the tendency of a bag to form an oval or football shape, during popping in the oven has a bearing on the ability of the bag to stand up straight as well as on the effectiveness of the susceptor (microwave interactive sheet material) provided in one face of the bag for absorbing microwave energy and transferring the energy in the form of heat to pop the corn.

In view of these shortcomings, it is an important objective of the invention to find a way to help maintain the faces of the bag in a flatter condition than heretofore so as to provide flat, vertically disposed walls when the bag is positioned in an upright position on a horizontal supporting surface such as a table. Another object is to find a way of better controlling the shape of a microwave popcorn bag to give it a more squared appearance that will better retain a rectangular expanded shape as popcorn is being popped within it in a microwave oven.

Another important object is to provide a way of forming a flat-bottomed bag from continuous roll stock material which can be expanded later during cooking so that the bag will stand up reliably when placed on a horizontal supporting surface. Another object is to provide a means of toughening the bag bottom through the addition of a stiffening element to assist the bag in holding its shape. Another object is to prevent the bottom end of the bag from having an oval or football shape following the popping operation in a microwave oven and to provide instead a bottom flat enought to allow the bag to stand up straight when one end is placed on a table or other horizontal surface.

These and other more detailed and specific objects of the present invention will be apparent in view of the following description setting forth by way of example but a few of the various forms of the invention that will be apparent to those skilled in the art once the principles described herein are understood.

SUMMARY OF THE INVENTION

A package is described comprising a bag with a pair of face panels joined by longitudinally extending, centrally projecting gussets that extend centrally along each side of the bag. The bottom of the bag has a strong permanent seal in which both faces are pinched together and the top has a rupturable seal formed from thermoplastic adhesive that allows the top to open during popping to form a vent after inflation has been completed. The bottom seal also includes adhesive seals that extend diagonally from the center of the bag obliquely toward the side edges and is pinched shut to provide a temporary fin seal across the entire lower end of the bag. The top seal has diagonal adhesive seals which extend centrally from each side of the bag. The top diagonal seals are constructed and arranged to provide, on each side, free-standing, outwardly projecting triangular corner flaps with sealed edges. The diagonal edges of the top seal intersect at two spaced apart points near the center of the bag. The two spaced points at the intersecting ends of the four flaps define the steam vent area for the bag.

The bottom fin seal is folded onto one of the face panels and bonded to it with adhesive to provide a stiffening element or stay extending across the bottom of the bag at the junction of the bottom diagonal seals. During popping, the stay and bottom diagonal seals cooperate to hold the bottom flat as steam and vapor expand the bag.

When the bag is in a flat condition, the gussets extend toward one another, almost to the center of the bag. The centermost folds of the gussets are therefore close enough together to the divide the bag into two parallel chambers: a lower chamber between the lower face panel of the bag and the gussets, and an upper chamber between the gussets and the upper face panel of the bag. The lower chamber is opened to receive the popcorn and shortening when the package is filled.

The invention will now be described by way of example with reference to the following figures.

THE FIGURES

DESCRIPTION OF THE PREFERRED EMBODIMENTS

Figure 1:
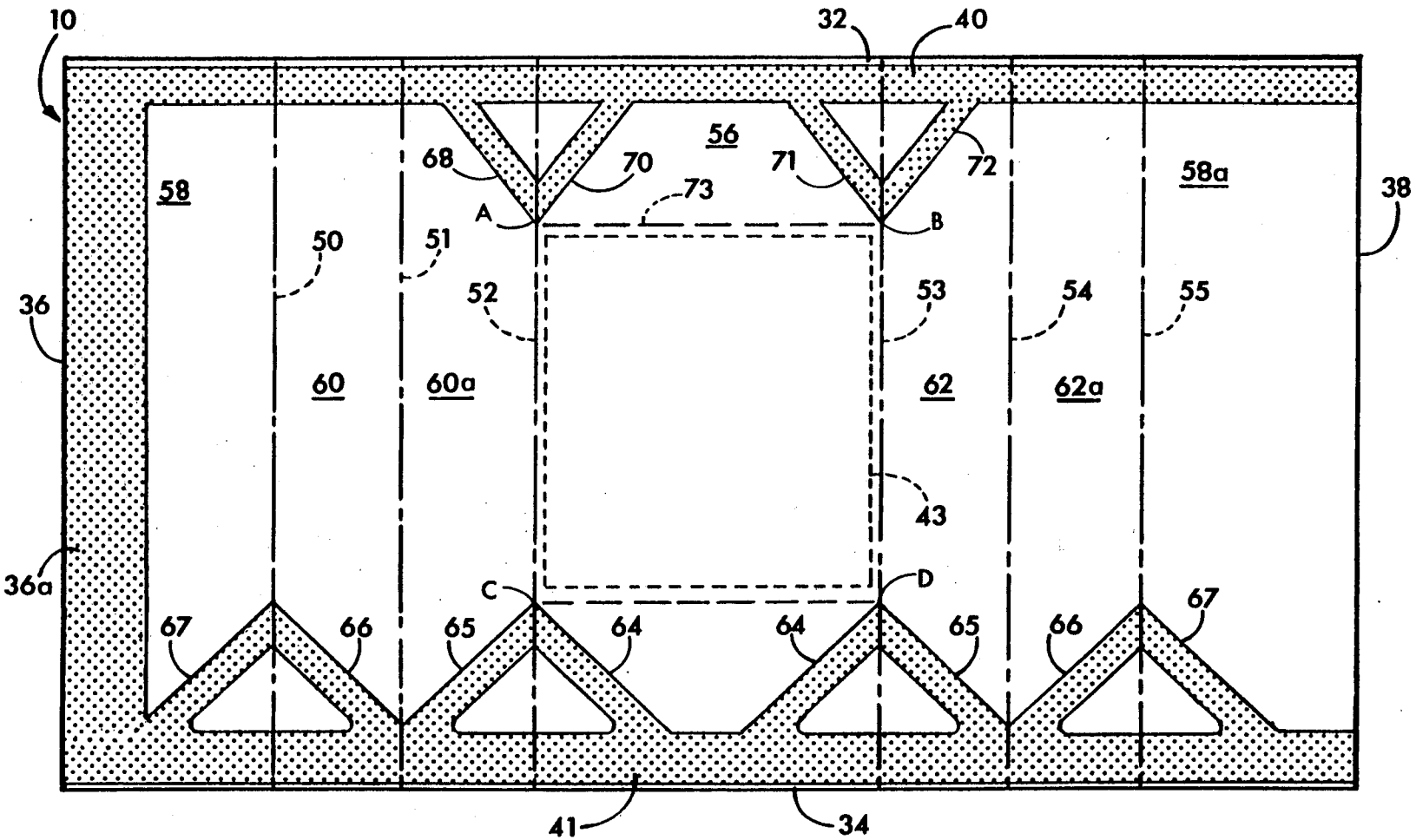
FIG. 1 is a plan view of the inside surface of a blank sheet of paper from which the package is formed showing a preferred adhesive pattern and susceptor.
Figure 1A:
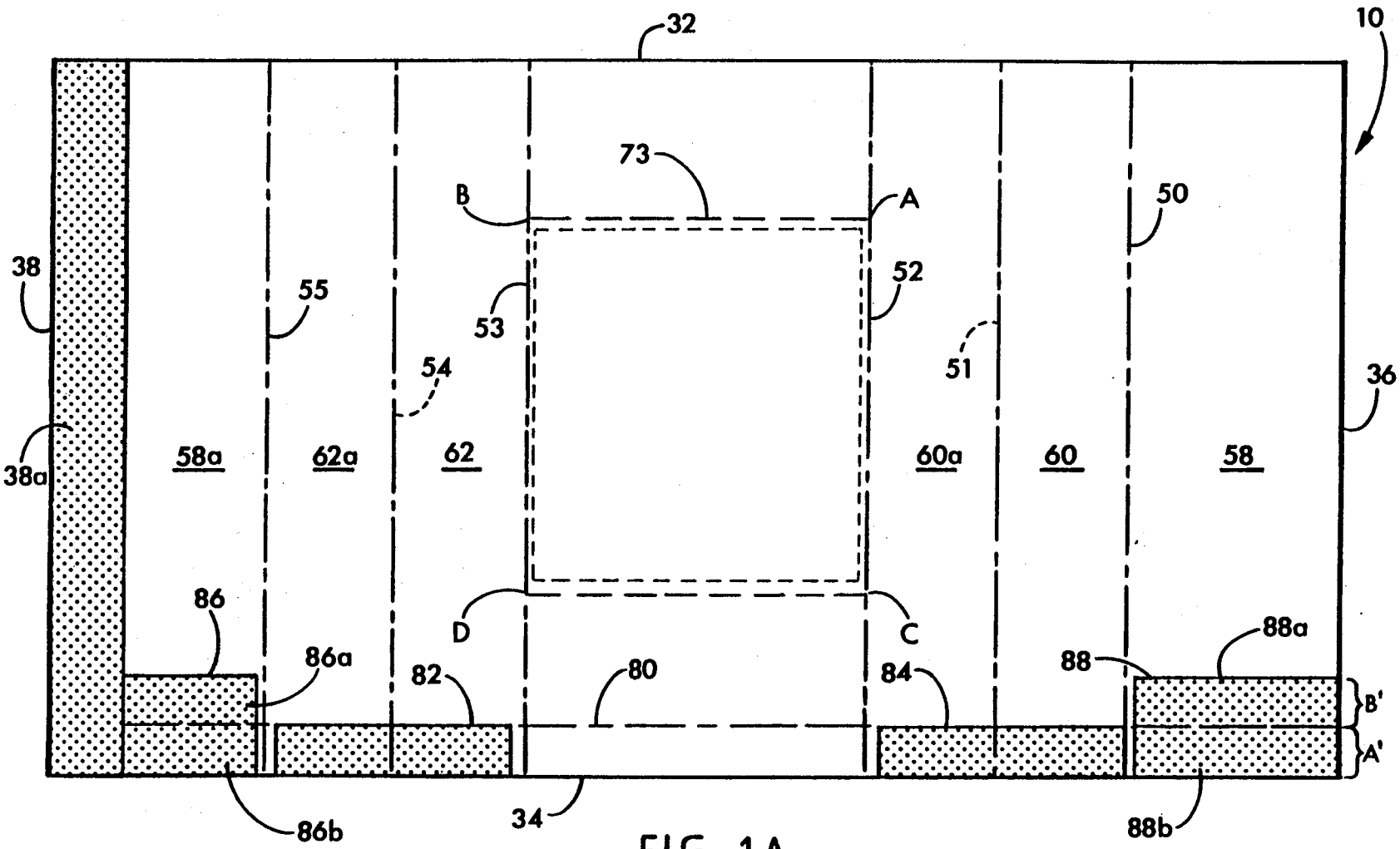
FIGURE 1A is a view similar to FIG. 1 showing the outside of the bag blank.

Refer now to FIGS. 1 and 1A which illustrate, respectively, the inside and outside of a flexible sheet 10, i.e. a blank, from which a bag 22 is formed. It should be understood that the sheet 10 is preferably just one segment of a long strip of roll stock (not shown) extending above and below it from which a series of bags are formed in a continuous form, fill and seal operation, by itself known to those skilled in the art.

It can be seen that the sheet 10 is rectangular in shape and includes parallel top and bottom edges 32 and 34, respectively, with parallel side edges 36 and 38 running at right angles thereto. The edge 32 forms the top of the bag while edge 34 forms the bottom of the bag. The side edges 36 and 38 of the blank are bonded in overlapping relationship as will be described below to form a longitudinally extending lap seam.

On the inside surface of the sheet 10 are a pair of top and bottom thermoplastic adhesive sealing bands 40 and 41, respectively, which can be applied using any suitable adhesive applying equipment. The adhesive bands 40 and 41, while they can be formed from any suitable commercially available adhesive, are preferably formed from a heat sensitive thermoplastic adhesive such as polyvinyl acetate or polyvinyl acetate copolymer adhesive at a coating weight of 5–7 lb/ream. One suitable adhesive is a thermosetting polyvinyl acetate emulsion adhesive which can be obtained, for example, from Franklin International, Inc., Columbus, Ohio, under the trade name Duracet 12. Other adhesives such as dextrin or starch base adhesive can be used if desired. Thermoplastic heat sealing adhesives are preferred when the bags are formed on high-speed automatic tube forming and filling equipment in which case seals are produced by holding the adhesive bands 40 and 41 together under heat and pressure.

The bands 40 and 41 can be of various widths but a fairly wide band, for example a band about ¾" wide, is preferred so that there is adequate room for "float," i.e., the variations in the position of the sheet 10 with respect to the end cut-off point and the position of the heated sealing jaws used for forming the seals at the ends of the bag.

Figure 8:
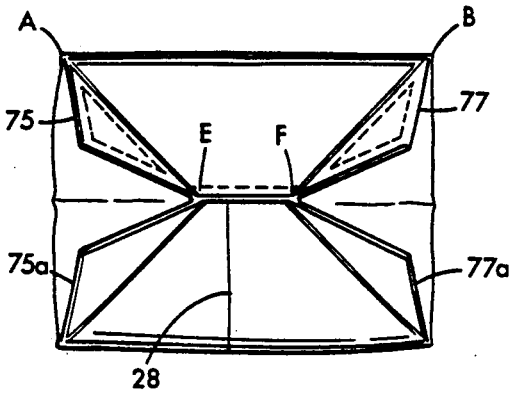
FIG. 8 is an end elevational view of the top end of the package as seen in FIG. 7 prior to the venting of steam from package.
Figure 9:
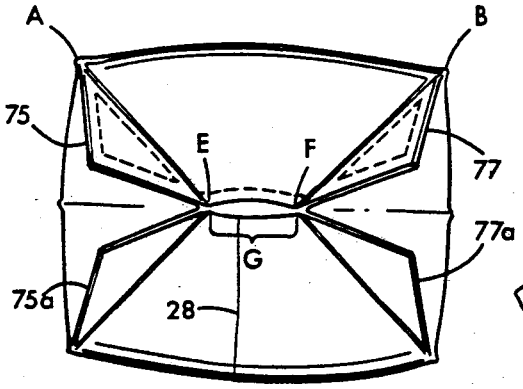
FIG. 9 is a view similar to FIG. 8 during the venting of steam.

The longitudinal seal 28 (FIGS. 8–10) is formed by providing vertically disposed adhesive bands 36' and 38' along the longitudinal edges and on opposite surfaces of the blank sheet 10. The bands 36' and 38' are also preferably formed from thermoplastic adhesive but a quick-setting dextrin adhesive or a resin type adhesive can be used if desired. The bands 36' and 38' contact one another when the bag 22 is formed into a tube with an overlap at lap seal 28. Consequently, a strong bond is formed between the two face-to-face adhesive layers.

Similarly, in the case of the end seals formed by adhesive bands 40 and 41, an adhesive band is always in contact with a part of the adhesive band on an opposing surface so that one layer of adhesive is sealed to another in face-to-face relationship. In this way, a secure bond is formed which is stronger than one produced with a single layer of adhesive bonded to plain paper.

The sheet 10 is preferably formed from two plies, e.g. an inner bleached greaseproof kraft paper of 25 lb/ream laminated to an outer plain bleached kraft sheet of 30 lb/ream by means of a suitable adhesive with a microwave susceptor 43, e.g. a metallized plastic film, sandwiched between the two kraft plies as described in U.S. Pat. Nos. 4,735,513, 4,878,675 or a coating as described in U.S. Pat. No. 4,970,358. The inner kraft ply can be grease-proof kraft paper. When the susceptor 43 is a coated film, a preferred adhesive to be used between the susceptor and the inner greaseproof kraft layer is a polyvinyl acetate resin-based emulsion adhesive such as Elektromek vinylacetate copolymer adhesive supplied by the Elektromek Company, Carlstadt, N.J. The Duracet 12 adhesive can be used elsewhere between the inner and outer paper sheets, both adhesives at a coating weight of 4–6 lb/ream. The susceptor 43 can be made in some cases as much as 25 percent larger than formerly used.

The sheet 10 is folded to form bag 22 during manufacture along six lines designed 50–55. The lines 50–55 do not indicate creases but only where folds will be formed when the bag 22 is completely assembled. Precreasing is not necessary for most applications. Between fold lines 52 and 53 is a lower panel 56. The upper face panel of the bag is formed by panel portions 58, 58*a* on opposite sides of fold lines 50 and 55, respectively. Between the upper face panel 58, 58*a* and the lower face panel 56 are gusset panels, the ones on the left in FIG. 1 being designated 60, 60*a*, while the ones on the right are designated 62 and 62*a*. The gusset panels are connected by the gusset folds 51 and 54, respectively.

At the bottom of the bag 22 are provided diagonal seals similar to those in U.S. Pat. No. 4,691,374 which correspond in position to diagonal edges of adhesive patches 64–67. The diagonal edges form seals between the gusset and each face panel comprising a pair of diagonal seal edges on the left and right side of the bag where diagonal patch 66 is sealed to patch 67 and diagonal patch 65 is sealed to patch 64. All of the diagonal seal edges are inclined upwardly and outwardly, i.e. away from the center line of the bag, and serve to bond each gusset panel to a portion of the adjacent face panel (upper or lower) in contact therewith. It should be clear that although adhesive bands have been shown on both the gussets and the adjacent face panels, it would be acceptable to use a band on only one of the contacting surfaces although a somewhat less secure bond would be formed.

At the top of the bag are provided a second set of seals having diagonal edges which comprise a first set of mating diagonal seals 68, 70 and a second set of mating diagonal seals 71, 72. Both sets are adapted to seal the gusset panels 60*a*, 62 to the lower face panel 56. It will be seen that the seals 68–72 are positioned so that the diagonal edges are inclined along lines that extend upwardly and centrally proceeding toward the top edge 32 of the bag.

As shown in FIGS. 4–9, the diagonal adhesive seals on each side of the bag top and adhesive strip 40 form four free-standing, outwardly projecting triangular flaps or pleats 75, 75*a*, 77, 77*a* on each side of the bag with diagonal sealed edges which intersect at two spaced apart points E and F near the center of the bag at the top end 32. The space between the points E, F at the intersection of the triangular flaps 75, 77 defines a steam vent area G which is shown closed in FIGS. 7 and 8 and shown open as it appears when steam is being vented in FIG. 9 during the last stages of popping when heat and pressure generated have caused the bag to inflate fully and have partially or completely melted adhesive in the vent area G.

As shown in FIGURE 1A, the outside of the bag blank has a pair of transversely extending adhesive strips 86 (which is divided into upper and lower portions 86*a* and 86*b* on opposite sides of a transverse fold line 80) and a strip 88 (which includes two portions 88*a* and 88*b* also on opposite sides of the transverse fold line 80). The strip 86 is positioned at the lower end of the panel 58*a* and the strip 88 is provided at the lower end of panel 58. In a preferred form of the invention, there are also provided a pair of optional transversely extending adhesive strips 82 and 84 on the outside surface of the bag blank in the gussets 60–62*a* for the purpose of bonding the lower edges of the abutting faces of the gussets together. While it is preferred to bond adjacent contacting ends of the gusset surfaces to one another, it is not essential to operation and can be avoided by eliminating adhesive strips 82 and 84, if desired.

While the width of the adhesive strips 86, 88 can be varied to suit circumstances depending upon the overall size of the bag, a typical bag 11.5 inches in height can employ strips 86*a*, 86*b*, 88*a* and 88*b* each 0.75 inch (2 cm) wide so that the total width of each of adhesive patches 86 and 88 is 1.5 inches (4 cm). All of the adhesive 82–88 can comprise a suitable heat resistant adhesive, such as an aqueous emulsion adhesive such as polyvinyl acetate polymer resin-based emulsion adhesive particles dispersed in water, e.g. Duracet adhesive already described. The adhesive strips 82–88 are applied at the same time all the other adhesive is applied to the bag, e.g. by transfer from an adhesive-applying roll (not shown) prior to forming the bag blank 10 into a tube. The bag is formed into a tube in the same manner described in U.S. Pat. No. 4,691,374 and is preferably filled with popcorn, and optionally shortening, while being formed forming and filling equipment of the type known as a "form-and-fill machine" in which a long, upright paper tube is formed and, during the forming thereof, food is introduced periodically while baglength sections of the tube are cut along transverse lines corresponding with the top and bottom edges 32 and 34 of the bag to divide the upright paper tube into a succession of bag-length pieces, each already filled with a charge of food, in this case a quantity of popcorn and shortening.

The longitudinal seal 28 is formed first by the application of heat and pressure sufficient to fuse the adhesive 36*a*, 38*a*. Transverse seals 40, 41 and the diagonal seals 64–72 are then formed, again by the application of heat and pressure, using, for example, heated metal jaws (not shown) of the type well known to those skilled in the art.

Figure 2:
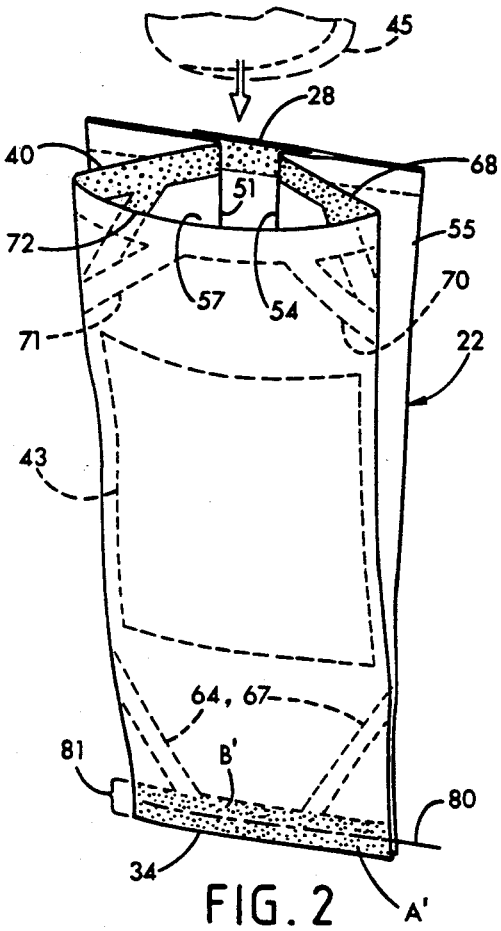
FIG. 2 is a perspective view of the package during filling just before a food product is introduced.
Figure 11:
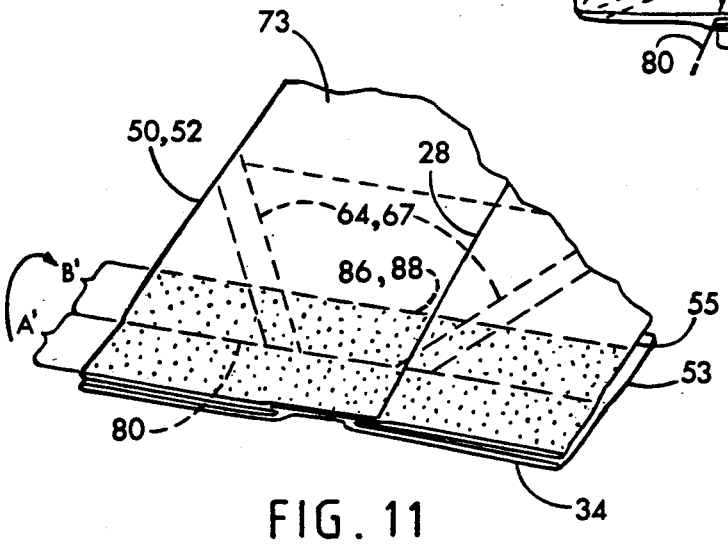
FIG. 11 is a partial perspective view of the bottom end of the bag as the bag is being formed.

After the tube is formed, the bottom portion of the bag 22 is pinched shut as shown in FIG. 2, with a downwardly projecting, free-standing fin 81 present. The fin 81 is made up of two parts, A' and B' on opposite sides of a transverse fold line 80. The adhesive 86, 88 can be added as a secondary operation, if desired, but it is preferred to apply it at the same time all of the other adhesive bands are applied. If no adhesive has already been applied, the transversely extending adhesive strips 86, 88 are then applied or, if already applied, the transverse adhesive strips 86, 88 can then be activated, e.g. by the application of heat and pressure. To accomplish this, the terminal portion A' is folded over by creasing the bag stock material along fold line 80 as indicated by the arrow in FIG. 11, and then pressing A' against the adjacent strip B'. The folded down section A' cooperates with the adhesive material 86, 88 to provide a transversely extending stay which acts as a stiffening element for later keeping the bottom of the bag flat as the bag inflates after the consumer places the bag in a microwave oven and the bag expands due to the gas and vapor evolved when the popcorn pops.

Figure 12:
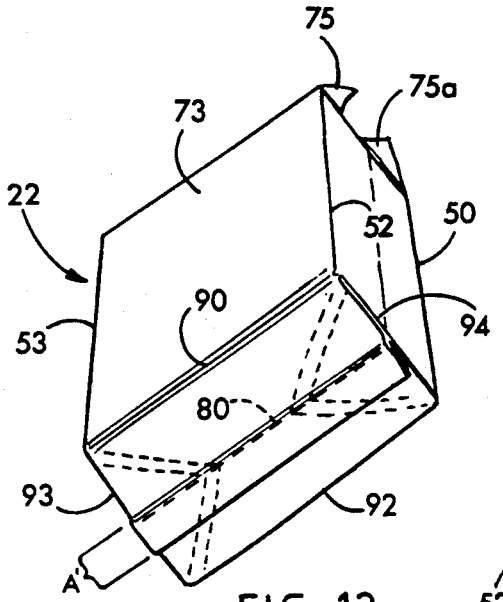
FIG. 12 is a bottom perspective view of the bag after expansion.
Figure 13:
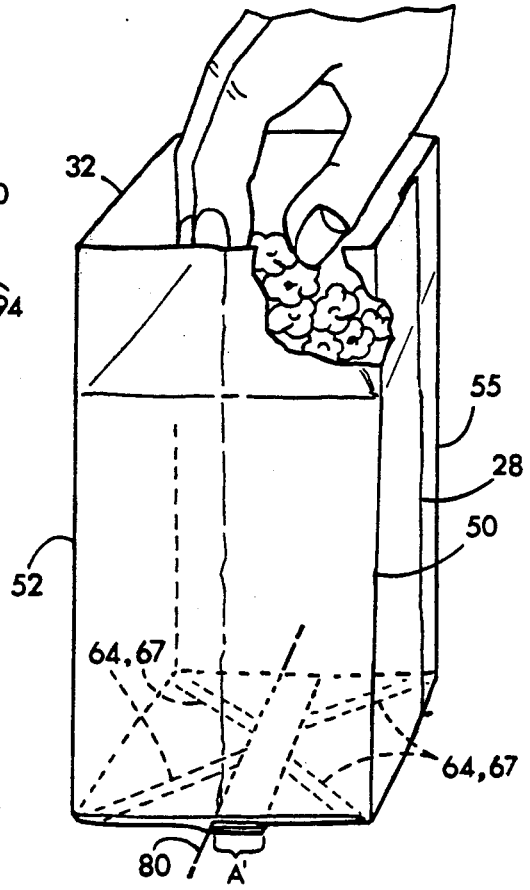
FIG. 13 is a perspective view of the bag standing up and in use after the top has been opened.

Thus, during the popping operation, the stiffening effect produced by the stay A' and underlying adhesive material 86, 88 cooperates with the diagonal adhesive bands 64, 67 to toughen the bag bottom and thus provide a relatively flat bottom for the bag as shown in FIGS. 12 and 13. This enables the bag to be placed in an upright position (FIG. 13) so that the consumer can easily reach into it to remove a handful of popcorn as the bag rests on a table or other horizontal surface.

During the popping operation, the vapor generated is surprisingly effective in inflating the bag and forming the flat bottom shown in FIGS. 12 and 13. It was found that the invention helps to achieve surprisingly rapid and complete expansion of the bag. In other words, it appears to expand more quickly and completely, and apparently more easily, than prior pinch-bottom bags of the type described in U.S. Pat. Nos. 4,450,180, 4,735,513 or 4,691,374, none of which can be stood on end. While the reason for the effectiveness of the invention is not known with certainty, it is believed that the diagonal seals 64–67 initially help the bottom of the bag form a flat surface while the face panels of the bag, softened by the hot steam inside, are able to fold easily along lines 90 between points C and D and line 92 of FIG. 12 as well as along lines 93 and 94 at the lower end of each of the gussets while the stiff stay member A' helps to keep the bottom surface of the bag flat once formed by the expanding steam inside the bag. In practice this steam and vapor-expanded bag is square enough on the bottom to stand up without additional mechanical manipulation due simply to the development of the internal pressure.

It was discovered that, upon heating the bag in a microwave oven until the corn pops, the apex of the sealed areas 68, 70 at A and those of diagonal seals 71–72 at B, cooperate with the apex of the points of the adhesive patches 64, 65 at C and D so that the four points of intersection A, B, C and D determine a rectangular lower panel area 73 containing the susceptor 43. The intersection between the glued points and lower panel area determined viz. these four points A, B, C and D causes the lower panel area 73 to remain relatively flat and to conform well to the oven floor during popping.

The bag described in U.S. Pat. No. 4,691,374 and all of the other microwave popcorn bags currently being marketed tend to form an oval or football shape when inflated. By contrast, the present invention, owing to the cooperation of the diagonal seals at the bottom and the provision of the free-standing outwardly projecting triangular flaps 75, 77 which converge at two spaced apart points E and F, forms a large lower panel 73 that stays flat to support the susceptor 43 as the package expands during microwave heating. This gives the package a rectangular or box-shaped configuration which substantially improves the popping performance as measured by the volume of popped corn, expansion density of the popped corn, the number of unpopped kernels remaining, package venting and bag scorching. The box shape also tends to be more consistent in shape and popping characteristics and is less affected by variables such as the rate of expansion, paper moisture, corn moisture, etc.

It was discovered that the improved rectangular or box-like shape of the package that has been achieved enhances the popping of the corn and overall performance. The angle of intersection of the diagonal seals affects the final bag geometry and can be optimized for different conditions. Good results have been achieved with an angle of about 42°-55° to the longitudinal axis of the bag for the lower and upper diagonal seals.

Figure 3:
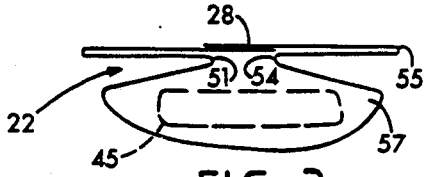
FIG. 3 is a top view of FIG. 2.
Figure 4:
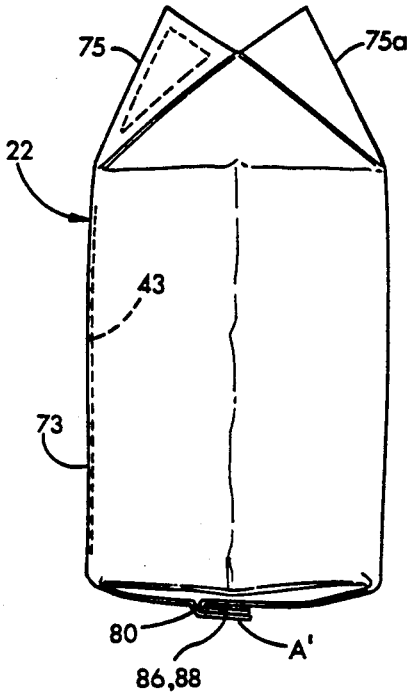
FIG. 4 is a side view of the package after the popcorn has been popped in a microwave oven.
Figure 5:
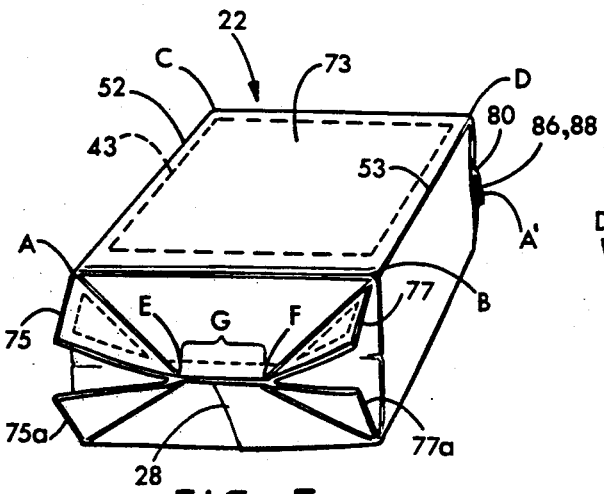
FIG. 5 is a perspective top end view of the package just after popping, with the package inverted with the lower face uppermost so that the susceptor can be seen.
Figure 6:
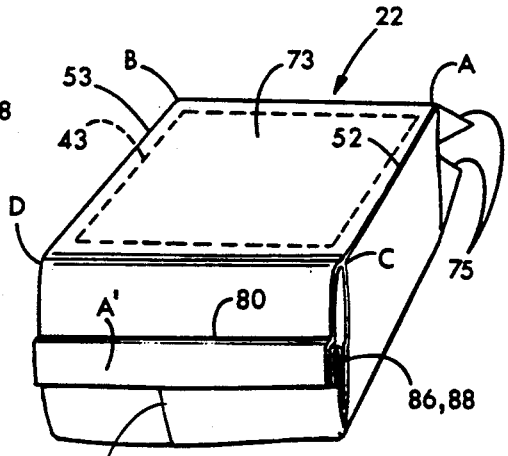
FIG. 6 is a perspective bottom end view of the package as it appears just after popping, but the package is inverted to show the lower face so that the susceptor can be seen.
Figure 7:
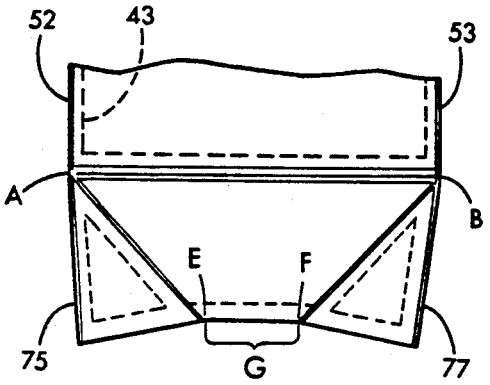
FIG. 7 is a plan view of the top end of the package of FIG. 5 on a slightly larger scale.

The term "diagonal seal" means a seal that has a diagonal edge relative to the longitudinal axis of the bag. The triangular areas within the seals 68-72 can be entirely covered with adhesive if desired. Moreover, adhesive can cover the entire surface of the paper if desired. Heated triangular jaws (not shown) can be used to seal the ends of the bag. In this case, the shape of the sealing jaws alone can be used to determine where the seals are located. Thus, the heat seal can be determined by the pattern of the heal seal adhesive or, if desired, by the pattern of the jaws. The amount of heat seal adhesive used and the inherent strength of the adhesive can be used to control the quality of the adhesive joints. After the bag is formed into a tube and the bottom seal formed, the popcorn and shortening 45 are introduced into chamber 57 as shown in FIGS. 2 and 3. The top seal is then formed with appropriately shaped heat sealing jaws.

Figure 10:
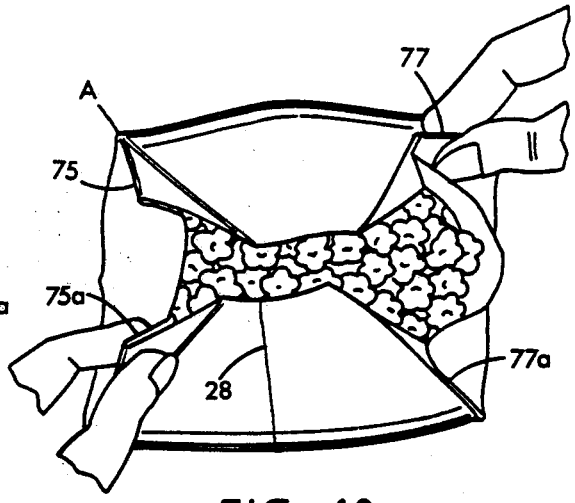
FIG. 10 is a view similar to FIG. 9 as the package appears as it is being opened.

After popping, the popcorn is removed from the bag by manually opening the top as shown in FIG. 10. The start of an opening at the top is produced through the vent G by internal steam pressure. As this occurs, the seal 40 at the top of the bag peels open when the internal pressure becomes sufficiently high. By having the top seal 40 of the bag weaker than the bottom seal 42, the bag 22 will always pop open at the top and is thus self-venting. Moreover, it will always open at the same spot G between the intersections of diagonal seals at E and F.

Many variations of the present invention within the scope of the appended claims will be apparent to those skilled in the art once the principles described herein are understood.

What is claimed is:

1. A bag for popping popcorn in a microwave oven comprising, as seen in an upright collapsed position, a pair of first and second rectangular face panels each having parallel top and bottom edges defining a top and a bottom of the bag and each face panel having parallel side edges, left and right longitudinally extending centrally projecting gusset folds extending between the first and second panels of the bag, the gussets separating the bag into a pair of communicating chambers, seals having diagonal edges at both the top and bottom of the bag between the gussets and at least the second face panel, the diagonal edges extending diagonally from the side edges of the second face panel proceeding centrally and toward an adjacent end of the bag, the face panels at the bottom of the bag being pinched together and being bonded to one another transversely all the way across to provide a temporary fin at the bottom end of the bag, the fin being folded along a transverse fold line parallel to the bottom edge of each face panel and being adhesively bonded to an adjacent outside surface of a face panel to form a transversely extending stay that acts as a stiffening element extending across a rectangular bottom wall of the bag which forms responsive to internal vapor and steam pressure developed during popping of the popcorn in said microwave oven, and said stay cooperating with the diagonal bottom seals to assist in maintaining the rectangular bottom wall in a flat condition when the bag inflates under pressure and when the top of the bag is opened for the removal of the popped corn, thereby enabling the bag to stand on said bottom wall when placed on a horizontal surface.

2. The bag of claim 1 wherein the diagonal seals at the top of the bag between the gusset folds and the second face of the bag are constructed and arranged to provide free-standing outwardly projecting triangular flaps with diagonally extending sealed edges that terminate near a center of said top edge of each face panel at two spaced apart points, a space between said two points at ends of the flaps defining a steam vent area of the bag that opens under the influence of internal pressure during cooking.

3 The bag of claim 1 wherein outer ends of the diagonal seals intersect the second face panel at four points A, B, C and D such that triangular flaps define a top edge of a rectangular face area in the second face panel containing a microwave interactive susceptor that remains relatively flat during popping of the popcorn in said microwave oven to provide a relatively large and flat supporting panel upon which the bag rests during cooking in the microwave oven to enhance popping of the corn.

4. The bag of claim 1 wherein the diagonal seals have an angle between about 42° and 55° relative to a longitudinal axis of the package.

5. The bag of claim 1 wherein the temporary fin is bonded to a surface of the bag with a heat-sealing adhesive by the application of heat and pressure.

6. The bag of claim 1 wherein a microwave interactive susceptor is provided in the bag and during heating the susceptor produces a portion of the heat that expands the bag for forming a lower portion of the bag into the rectangular bottom wall.

7. The bag of claim 1 wherein the bag is a tube filled with popcorn and sealed at the top and bottom of the bag.

* * * * *